United States Patent [19]

Santo

[11] 3,957,631

[45] May 18, 1976

[54] PORTABLE SCREENING APPARATUS

[75] Inventor: David Santo, Los Angeles, Calif.

[73] Assignee: Lawrence Peska Associates, Inc., New York, N.Y. ; a part interest

[22] Filed: Mar. 19, 1975

[21] Appl. No.: 559,695

[52] U.S. Cl. ..... 209/421; 209/288; 209/370; 209/385

[51] Int. Cl.[2] ..... B07B 1/22

[58] Field of Search ..... 209/204, 288, 370, 482, 209/473, 293, 294, 412, 298, 299, 420, 421, 249, 279, 379, 385

[56] References Cited

UNITED STATES PATENTS

| | | | |
|---|---|---|---|
| 829,665 | 8/1906 | McCollum | 209/284 |
| 901,519 | 10/1908 | Burke | 209/284 X |
| 1,069,244 | 8/1913 | Ford | 209/284 |
| 3,426,898 | 2/1969 | Cruickshank | 209/284 X |

FOREIGN PATENTS OR APPLICATIONS

| | | | |
|---|---|---|---|
| 21,135 | 9/1914 | United Kingdom | 209/284 |
| 757,918 | 10/1933 | France | 209/284 |
| 819,168 | 9/1951 | Germany | 209/412 |
| 1,371,955 | 8/1964 | France | 209/288 |

*Primary Examiner*—Robert Halper
*Attorney, Agent, or Firm*—Richard E. Nanfeldt

[57] ABSTRACT

A portable screening apparatus comprises a base assembly having a two wheel assembly associated therewith. A shaft is journaled through a block member affixed onto the base assembly, wherein a handle member is affixed onto the outer end of the shaft. A frusto-conical drum has a top cover, a bottom base, and an annular sidewall, wherein the sidewall has a plurality of openings therethrough. The top end of the drum rotatably communicates with the base assembly. A bracket member is affixed onto an outside surface of the bottom base of the drum, wherein the forward end of the shaft is mounted into the bracket member. A frusto-conical shaped screen member is contained within the drum.

5 Claims, 4 Drawing Figures

PORTABLE SCREENING APPARATUS

SUMMARY OF THE INVENTION

My invention relates to a unique and novel screening apparatus for siftng loose materials such as a mixture of sand and rocks.

A number of U.S. Patents Nos. 1,198,395; 1,539,123; and 3,208,593 have employed multiple devices and bottom end dispensing devices, which are non-applicable to my present invention.

An object of my present invention is to provide a screening apparatus of simple design and relatively low manufacturing cost for sifting loose materials such as a mixture of sand and rocks.

A further object of my present invention is to provide a screening apparatus having a drum with a screen member contained within the drum, wherein the sidewall of the drum has a plurality of openings therethrough.

Briefly, my present invention comprises a base assembly having a two wheel assembly associated therewith. A shaft is journaled through a block member affixed onto the base assembly, wherein a handle member is affixed onto the outer end of the shaft. A frusto-conical drum has a top cover, a bottom base, and an annular sidewall, wherein the sidewall has a plurality of openings therethrough. The top end of the drum rotatably communicates with the base assembly. A bracket member is affixed onto an outside surface of the bottom base of the drum wherein the forward end of the shaft is mounted into the bracket member. A frusto-conical shaped screen member is contained within the drum.

BRIEF DESCRIPTION OF THE DRAWINGS

The objects of the invention may be understood with references to the following detailed description of an illustrative embodiment of the invention, taken together with the accompanying drawings in which.

DESCRIPTION OF THE PREFERRED EMBODIMENT

Figure 1:
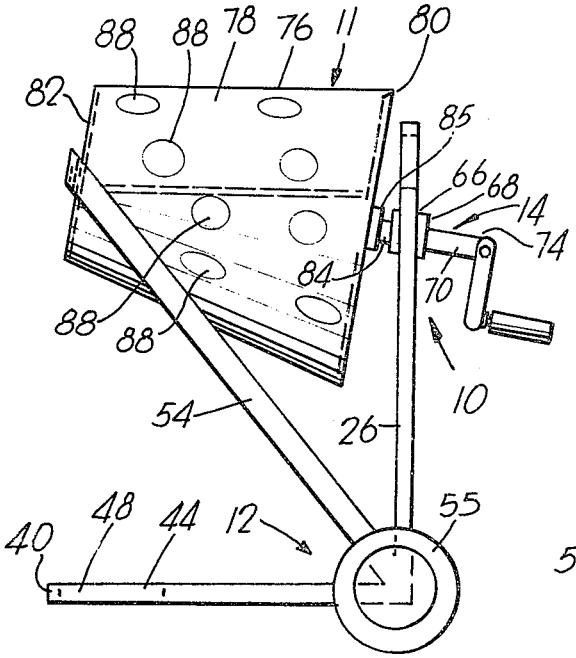
FIG. 1 illustrates a side view of a portable screening apparatus.

Turning now descriptively to the drawings, in which similar reference characters denote similar elements throughout the several views, FIG. 1 shows a portable screening apparatus 10 used for screening or sifting a mixture of rocks and sand. The apparatus 10 generally comprises a rotating screen means 11, a drive means 14 for rotating the screen means 10, and a portable base assembly 12 communicating with the screen means 10 and the drive means 14.

Figure 2:
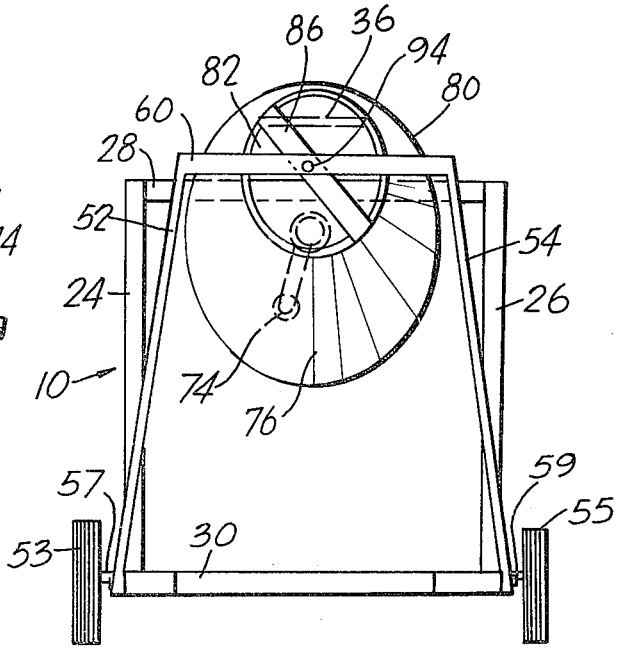
FIG. 2 illustrates an end cross sectional view of the portable screening apparatus.
Figure 3:
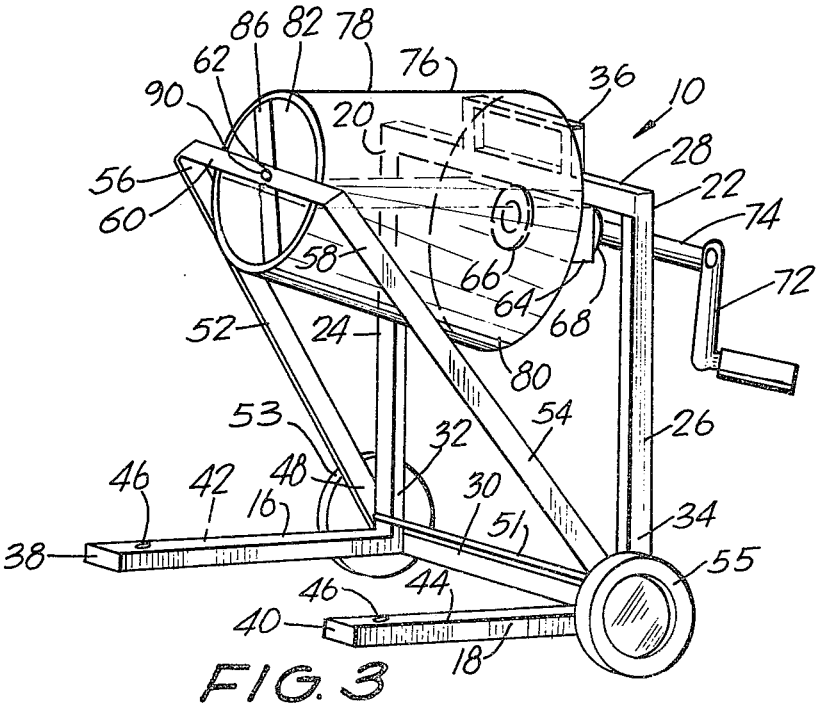
FIG. 3 illustrates a perspective view of the portable screening device.

FIGS. 1–3 show a more detailed embodiment of the apparatus 10, wherein the base assembly 12 comprises a pair of parallel, spaced L-shaped members 16, 18. The upper ends 20, 22 of the vertical arms 24, 26 of each member 16, 18 are joined together by a first horizontal cross bar 28. A second horizontal cross bar 30 joins together the lower ends 32, 34 of arms 24, 26. A handle member 36 is centrally affixed onto a top face of the first horizontal cross bar 28. The outer free ends 38, 40 of the horizontal arms 42, 44 of members 16, 18 are weighted with lead inserts 46. The lower ends 48, 50 of a pair of elongated bars 52, 54 are affixed onto each arm 24, 26 at the lower ends 32, 34 thereof. The bars 52, 54 extend upwardly in a forward direction at an acute angle relative to horizontal arms 42, 44, wherein the upper free ends 56, 58 of bars 52, 54 vertically align with the outer free ends 38, 40 of arms 42, 44. A cross bar member 60 having a central transverse hole 62 therethrough is joined onto the upper free ends 56, 58 of bars 52, 54. A horizontal axle rod 51 passes through the lower ends 48, 50 of bar members 52, 54, wherein wheel members 53, 55 are affixed onto the outer ends 57, 59 of axle rod 51. A block member 64 having a central bore 66 therethrough is centrally affixed onto a bottom surface of the first horizontal cross bar 28. A suitable bearing assembly 68 is contained within bore 66, wherein a short shaft 70 is journaled through the bearing assembly 68 and shaft 70 is tilted sightly upward in a forward direction. A handle assembly 72 is pivotally mounted onto the outer end 74 of shaft 70. A frusto-conical shaped drum 76 has an annular sidewall 78, a closed large bottom base 80, and a smaller top cover 82, wherein the drum 76 is tilted slightly upward in a forward direction. The top cover 82 has a central aperture therethrough (not shown). The forward end 84 of the shaft 70 is rotatably mounted into a bracket member 85 affixed centrally onto the outside surface of bottom base 80. A scraper blade 86 is contained within drum 76 just inside top base 82, wherein a bolt member 90 affixed onto the center of blade 86 passes through hole 62 of bar member 60 and aperture 94 of top cover 82. A nut member (not shown) threadably engages a outer threaded free end of bolt member 90 and abutts member 60. The annular sidewall 78 of the drum 76 has a plurality of openings 88 therethrough.

Figure 4:
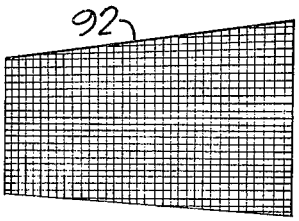
FIG. 4 illustrates a side view of a screen member of the portable screening apparatus.

FIGS. 2, 4 show a frusto-conical shaped screen member 92 which inserts within drum 76 through the top cover 82, wherein the top cover 82 is detachably mounted onto the annular sidewall 78 of the drum 76.

In use, the rotating shaft 70 causes drum 76 to rotate, wherein a sand and dirt mixture within the screen member 92 is sifted through the openings 88. As drum 76 rotates, the scraper blade 86 is maintained in a fixed position 50 so as to permit a constant cleaning of the inside face of the top cover 82.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A portable apparatus for screening a mixture of sand and rocks, which comprises:

a. a base assembly includng:

1. a pair of L-shaped members, each said member having a vertical and a horizontal arm;
2. each said vertical arm having an upper and a lower end;
3. each said horizontal arm having an outer free end;
4. a first cross bar joined between said upper ends of said vertical arms of said L-shaped members;

5. a second cross bar joined between said lower ends of said vertical arms;
6. a pair of elongated bars affixed onto said lower ends of said vertical arms, said elongated bars extending upwardly in a forward directon at an acute angle relative to said horizontal arms;
7. each said elongated bar having an upper end; and
8. a cross bar member communicating between the upper free ends of said elongated bars, said cross bar member having a central transverse hole therethrough;

b. a block member having a central bore therethrough mounted onto a bottom face of said first cross bar;
c. a bearing assembly contained in said bore;
d. a short shaft journaled through said bearing assembly;
e. a handle assembly pivotally mounted onto an outer end of said shaft;
f. a drum having an annular sidewall, a top cover, and a bottom base, said top cover detachably secured to said sidewall;
g. a bracket member mounted onto an outside surface of said bottom base of said drum;
h. a forward end of said shaft rotatably mounted into said bracket member;

i. means for joining said top cover of said drum to said cross bar member;
j. said annular sidewall having a pluraity of openings therethrough; and
k. a frusto-conical shaped screen member contained within said drum.

2. A screening apparatus as recited in claim 1, wherein a handle member is affixed onto said first cross bar member.

3. A screeing apparatus as recited in claim 2, wherein a two wheel assembly communicates with said base assembly.

4. A screeing apparatus as recited in claim 3, wherein the outer free ends of said horizonal arms have lead weights inserted therein.

5. A screening apparatus as recited in claim 4, wherein said means for joining further comprises:

a. a scraper blade contained within said drum just inside said top cover;
b. said top cover having a central aperture therethrough;
c. a bolt member having a threaded outer surface affixed onto a center of said scraper blade extending through said aperture of said top cover and said hole of said cross bar member; and
d. a nut member threadably engaging said threaded outer surface of said bolt member.

* * * * *